US007374277B2

(12) United States Patent
Nakayama

(10) Patent No.: US 7,374,277 B2
(45) Date of Patent: May 20, 2008

(54) INK-JET HEAD

(75) Inventor: Koji Nakayama, Seki (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 433 days.

(21) Appl. No.: 11/226,230

(22) Filed: Sep. 15, 2005

(65) Prior Publication Data

US 2006/0061633 A1 Mar. 23, 2006

(30) Foreign Application Priority Data

Sep. 17, 2004 (JP) ..... 2004-271326

(51) Int. Cl.
*B41J 2/045* (2006.01)
*B41J 2/14* (2006.01)

(52) U.S. Cl. ..... 347/68; 347/50

(58) Field of Classification Search ..... 347/50, 347/68, 70–72
See application file for complete search history.

(56) References Cited

U.S. PATENT DOCUMENTS 6,270,193 B1 * 8/2001 Hiwada ..... 347/50
7,004,565 B2 * 2/2006 Suzuki et al. ..... 347/50
7,036,916 B2 * 5/2006 Sakaida et al. ..... 347/68
2004/0130604 A1 7/2004 Watanabe et al.
2004/0183867 A1 9/2004 Hirota

FOREIGN PATENT DOCUMENTS

| | | |
|---|---|---|
| JP | 2000248765 | 9/2000 |
| JP | 2004-114342 | 4/2004 |
| JP | 2004205411 | 7/2004 |
| JP | 2004-276562 | 10/2004 |

* cited by examiner

*Primary Examiner*—An H. Do
(74) *Attorney, Agent, or Firm*—Banner & Witcoff, Ltd

(57) ABSTRACT

An ink-jet head includes a passage unit, an actuator unit, a flexible cable, conductors, and spacers. The actuator unit has individual electrodes corresponding to respective pressure chambers of the passage unit. The flexible cable has wirings corresponding to the respective individual electrodes and is spaced apart from the actuator unit. The conductors are disposed between the actuator unit and the flexible cable so as to electrically connect the individual electrodes to the wirings, respectively. The spacers, which are not electrically connected to the individual electrodes and the wirings, are disposed between the actuator unit and the flexible cable so that each of the spacers is positioned in a region surrounded by three or more of the conductors.

23 Claims, 11 Drawing Sheets

INK-JET HEAD

BACKGROUND OF THE INVENTION

1. Field of the Invention

The present invention relates to an ink-jet head that ejects ink to a record medium to conduct recordings.

2. Description of Related Art

An ink-jet head having an actuator unit that extends over many pressure chambers is known (see Japanese Patent Unexamined Publication No. 2004-114342). This actuator unit includes piezoelectric sheets that extend over many pressure chambers, and individual electrodes that are formed on an upper face of an uppermost one of the piezoelectric sheets so as to correspond to the respective pressure chambers. A passage unit, which has pressure chambers formed in its upper face and many nozzles formed in its lower face, has this actuator unit bonded to its upper face so that the pressure chambers are covered with the actuator unit. Each individual electrode is electrically connected to a contact of a flexible flat cable such as an FPC (flexible printed circuit), a COF (chip on film), etc.

Driving of the actuator unit causes the piezoelectric sheets to exhibit unimorph deformation by a transversal piezoelectric effect. In order to promote efficiency of deformation of the actuator unit, the flexible cable must be kept out of contact with a region on the piezoelectric sheet corresponding to each pressure chamber. From such a standpoint, in the aforementioned head, a conductive member called a "land" which is thicker than the individual electrode is provided in a region of the piezoelectric sheet corresponding to no pressure chamber such that the land is in contact with the individual electrode. Thus, the individual electrode and the contact of the flexible cable are electrically connected via the land. The piezoelectric sheet has a trapezoidal shape in a plan view, and many dummy electrodes are formed along upper and lower sides of the trapezoidal shape. Each dummy electrode is bonded to a contact of the flexible cable.

SUMMARY OF THE INVENTION

The lands and the dummy electrodes are bonded to the contacts of the flexible cable using a binder such as solder, a thermosetting conductive adhesive, etc., which requires a heat treatment in a bonding process. This heat treatment may cause the flexible cable to deform downward and thus come into contact with a region on the piezoelectric sheet corresponding to a pressure chamber. In this case, the flexible cable cannot be separated from the piezoelectric sheet even after it cools down to the ordinary temperature. This hinders deformation of the actuator unit.

An object of the present invention is to provide an ink-jet head capable of preventing a flexible cable from coming into contact with an actuator unit thus hindering deformation of the actuator unit.

According to an aspect of the present invention, there is provided an ink-jet head comprising a passage unit, an actuator unit, a flexible cable, a plurality of conductors, and a plurality of spacers. The passage unit has a plurality of nozzles and a plurality of pressure chambers that communicate with the respective nozzles and are arranged in a two-dimensional manner. The actuator unit is attached to the passage unit so as to cover two or more of the pressure chambers and has a plurality of individual electrodes corresponding to the respective pressure chambers, a common electrode formed to correspond to the individual electrodes, and a piezoelectric sheet sandwiched between the individual electrodes and the common electrode. The flexible cable has a plurality of wirings corresponding to the respective individual electrodes and is spaced apart from the actuator unit in a direction perpendicular to a plane of the piezoelectric sheet. The conductors are disposed between the actuator unit and the flexible cable so as to electrically connect the individual electrodes to the wirings, respectively. The spacers, which are not electrically connected to the individual electrodes and the wirings, are disposed between the actuator unit and the flexible cable so that each of the spacers is positioned in a region surrounded by three or more of the conductors.

In this aspect, deformation of the flexible cable toward the actuator unit can be suppressed, because the spacers disposed between the actuator unit and the flexible cable support the flexible cable. Therefore, the flexible cable hardly comes into contact with regions of the actuator unit corresponding to the pressure chambers, thus preventing hindrance of deformation of the actuator unit which may otherwise be caused by the flexible cable coming into contact with the actuator unit.

BRIEF DESCRIPTION OF THE DRAWINGS

Other and further objects, features and advantages of the invention will appear more fully from the following description taken in connection with the accompanying drawings in which.

DESCRIPTION OF THE PREFERRED EMBODIMENTS

Figure 1:
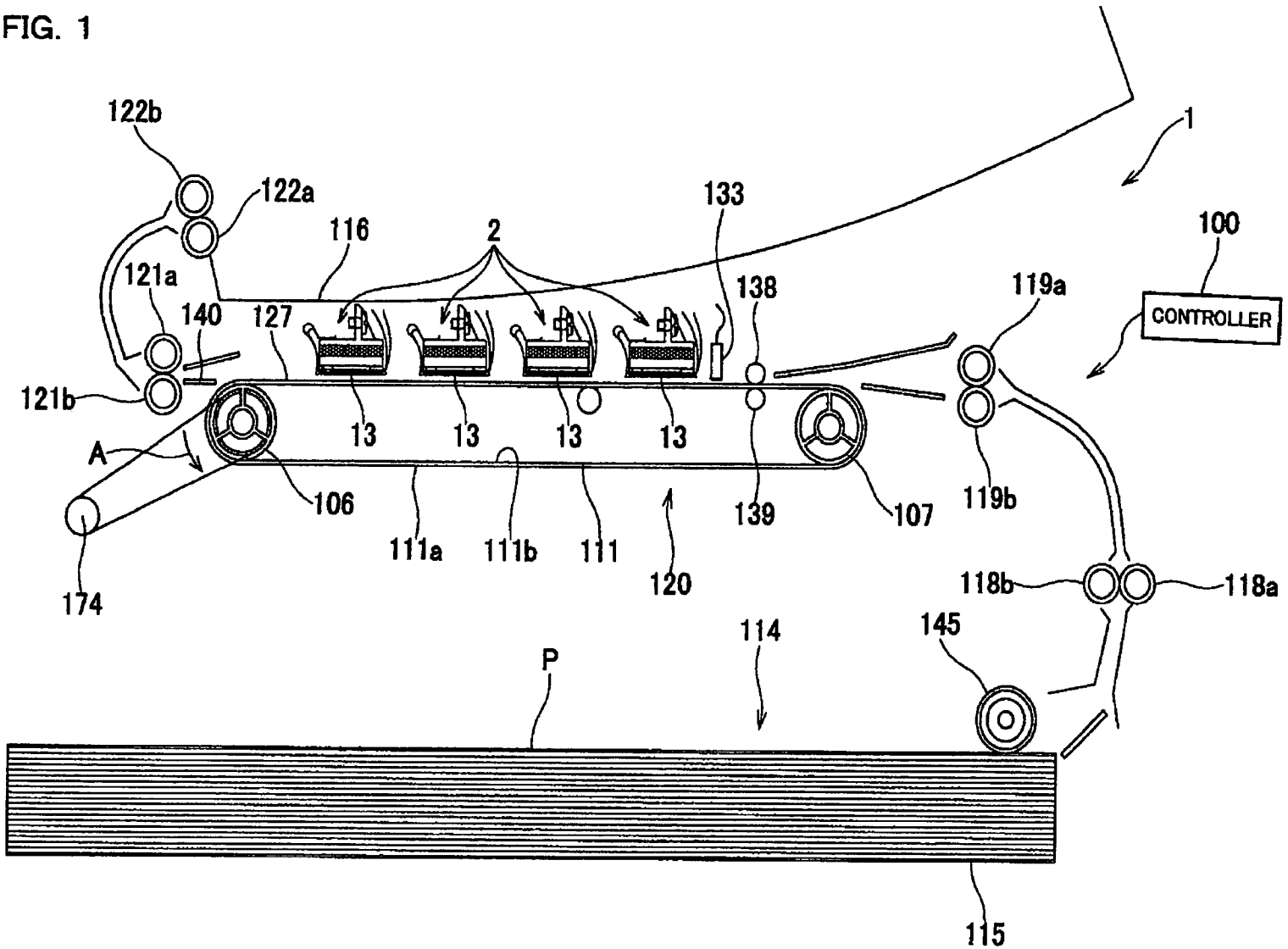
FIG. 1 schematically illustrates a printer that includes an ink-jet head according to a first embodiment of the present invention.

First, with reference to FIG. 1, a description will be given to a printer that includes ink-jet heads according to a first embodiment of the present invention. A printer 1 is a color ink-jet printer of line-head type and includes four fixed ink-jet heads 2 each having a rectangular shape in a plan view and extending in a direction perpendicular to the drawing sheet of FIG. 1. The printer 1 is provided with a paper feeder 114 in its lower part, a paper catcher 116 in its upper part, and a conveyance unit 120 in its middle part. The printer 1 further includes a controller 100 that controls the above-described units.

The paper feeder 114 includes a paper stacker 115 in which papers P as print media can be stacked, and a paper feed roller 145 that sends toward the conveyance unit 120 topmost one of the papers P that are stacked in the paper stacker 115. The paper P is stacked in the paper stacker 115 in such a manner that it is fed out in a direction along its longer side.

Pairs of feed rollers 118*a*, 118*b* and 119*a*, 119*b* are disposed along a paper conveyance path between the paper feeder 115 and the conveyance unit 120. Referring to FIG. 1, the paper P fed out of the paper feeder 114 is sent upward with its one shorter side, i.e., its leading edge, being pinched in the pair of feed rollers 118*a*, 118*b*, and then sent toward the conveyance unit 120 by means of the pair of feed rollers 119*a*, 119*b*.

The conveyance unit 120 includes two belt rollers 106 and 107, and a looped conveyor belt 111 spanning these rollers 106 and 107. The belt rollers 106 and 107 are in contact with an inner surface 111*b* of the conveyor belt 111. One belt roller 106 located on a downstream part in the paper conveyance direction (i.e., on a left side in FIG. 1) is a drive roller and connected to a conveyance motor 174 that is driven under control of the controller 100. The other belt roller 107 is a slave roller and rotated by rotary force which is caused by rotation of the belt roller 106 and given through the conveyor belt 111.

A length of the conveyor belt 111 is adjusted such that predetermined tension may arise in the belt 111 between the belt rollers 106 and 107. The conveyor belt 111, which is wrapped around the belt roller 106 and 107 to span them, forms two parallel planes each including a common tangent to the belt rollers 106 and 107. The upper one of the two planes facing the heads 2 provides a conveyor face 127 for the paper P. An outer surface 111*a* of the conveyor belt 111 is treated with an adhesive silicone rubber. Therefore, in association with rotation of the belt roller 106 in a counter-clockwise direction in FIG. 1 as indicated by an arrow A, the paper P can be conveyed while kept onto the conveyor face 127 of the conveyor belt 111.

Nip rollers 138 and 139 are disposed near the belt roller 107 in such a manner that they may sandwich the conveyor belt 111. Each of the nip rollers 138 and 139 has a rotatable cylindrical body having a length substantially equal to an axial length of the belt roller 107. A spring (not shown) biases the nip roller 138 so that the nip roller 138 can press the paper P against the conveyor face 127 of the conveyor belt 111. The nip rollers 138 and 139 nip the paper P together with the conveyor belt 111, in order to ensure that the paper P can be kept on the conveyor face 127 without separation therefrom.

A peeling plate 140 is disposed near the belt roller 106. An end portion of the peeling plate 140 gets into between the paper P and the conveyor face 127 of the conveyor belt 111, so that the paper P kept on the conveyor face 127 of the conveyor belt 111 is peeled away from the conveyor face 27.

Pairs of feed rollers 121*a*, 121*b*, and 122*a*, 122*b* are provided between the conveyance unit 120 and the paper catcher 116. Referring to FIG. 1, the paper P fed out of the conveyor unit 120 is sent upward with its one shorter side, i.e., its leading edge, being pinched in the pair of feed rollers 121*a*, 121*b*, and then sent toward the paper catcher 116 by means of the pair of feed rollers 122*a*, 122*b*. Printed papers P are stacked in the paper catcher 116 one after another.

A paper sensor 133 is disposed between the nip roller 138 and the most upstream ink-jet head 2 in the paper conveyance direction. The paper sensor is an optical sensor that includes a light-emitting element and a light-receiving element. When a leading edge of the paper P reaches a detection position, the paper sensor 133 outputs a detection signal in accordance with which a print signal is supplied to the heads 2.

Each of the four heads 2 has a head main body 13 at its lower end. The four head main bodies 13 are arranged adjacent to one another along a horizontal direction of FIG. 1. Many nozzles 8 each having a small diameter are formed in a lower face of each head main body 13 (see FIGS. 2 and 4). The four head main bodies 13 eject from their nozzles 8 magenta ink, yellow ink, cyan ink, and black ink, respectively.

A narrow gap is formed between the lower face of the head main body 113 and the conveyor face 127 of the conveyor belt 111. The paper P is conveyed through this gap from right to left in FIG. 1. While the paper P is passing under the four head main bodies 13, ink is ejected from the nozzles 8 to the paper P in accordance with image data, so that a desired color image is formed on the paper P.

Figure 2:
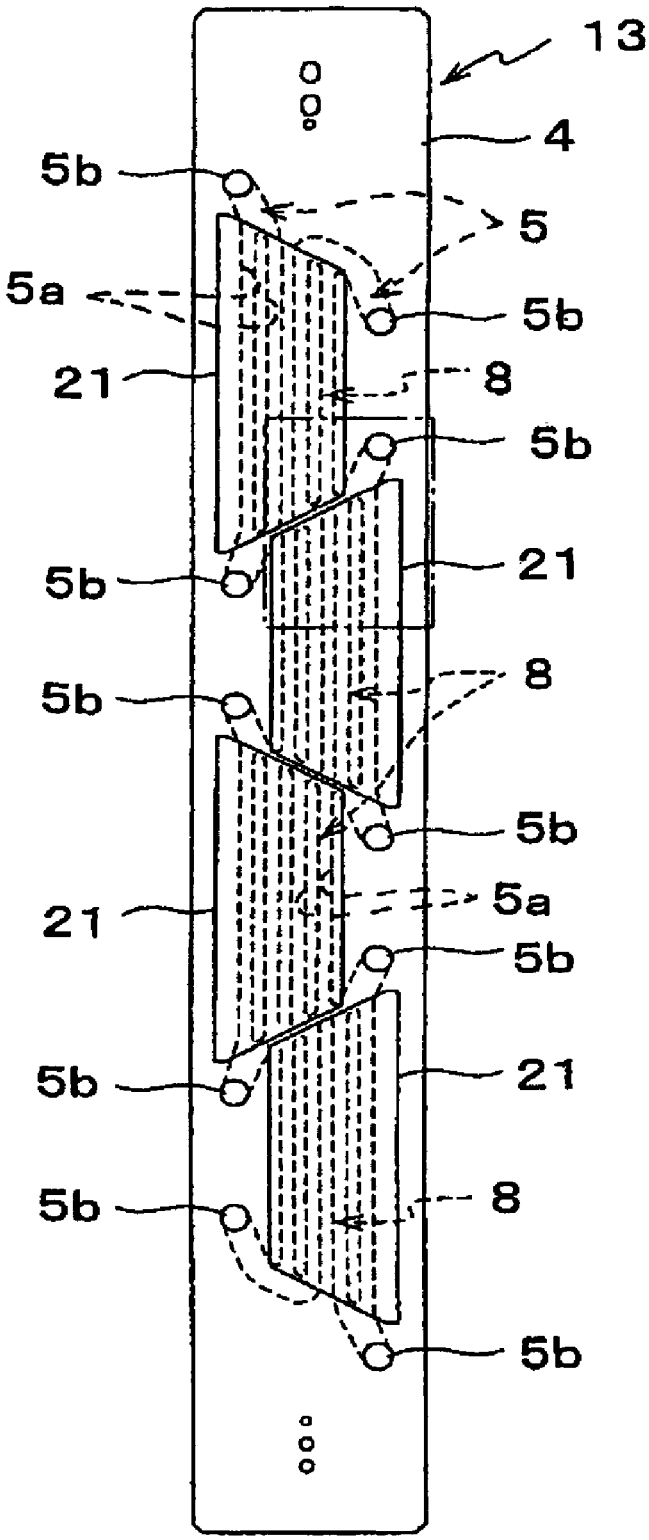
FIG. 2 is a plan view of a head main body of the ink-jet head.

Next, the head main body 13 will be described in more detail with reference to FIGS. 2, 3, and 4. The head main body 13 includes a passage unit 4, and four trapezoidal actuator units 21 (see FIG. 2). The passage unit 4 has a rectangular shape in a plan view and extends in a direction perpendicular to the paper conveyance direction.

Figure 4:
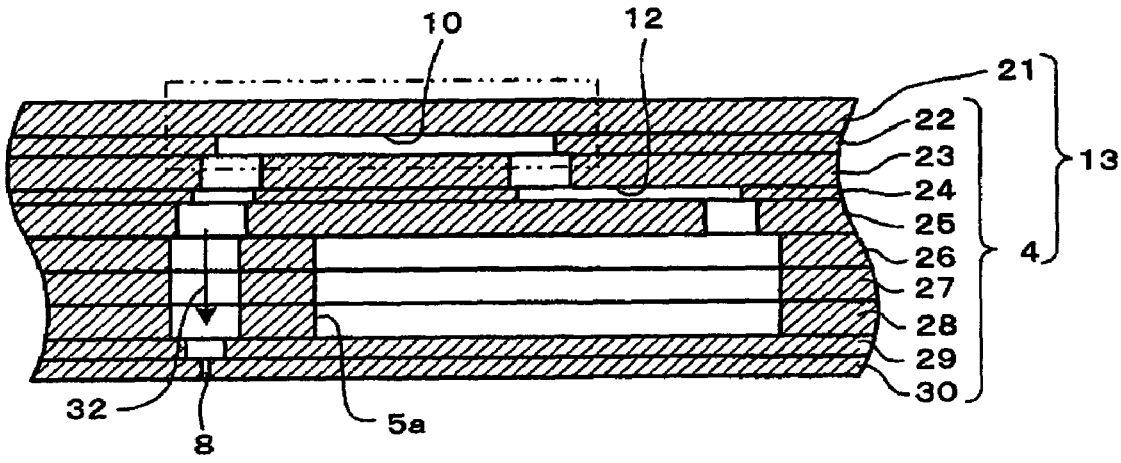
FIG. 4 is a sectional view taken along a line IV-IV of FIG. 3.

As shown in FIG. 4, many nozzles 8 that eject ink to the paper P are formed in a lower face of the passage unit 4. Pressure chambers 10 each communicating with each nozzle 8 are formed in an upper face of the passage unit 4. In addition, formed inside the passage unit 4 are sub manifold channels 5*a* each corresponding to two or more pressure chambers 10 in order to store ink which will be supplied to these corresponding pressure chambers 10. The sub manifold channel 5*a* branches from a manifold channel 5. Also formed in the passage unit 4 are ink passages 32 each provided individually for each nozzle 8 and each extending through a pressure chamber to a nozzle 8.

The actuator unit 21 applies pressure to ink contained in a desired one of the many pressure chambers 10. As shown in FIGS. 3 and 4, the actuator unit 21 is bonded to an upper face of the passage unit 4 so that it may cover many pressure chambers 10. As shown in FIG. 2, the four actuator units 21 are arranged in two rows in a zigzag pattern. Parallel opposed sides, i.e., upper and lower sides, of each trapezoidal actuator unit 21 are along an extension direction of the passage unit 4, i.e., along a vertical direction in FIG. 2. Oblique sides of every neighboring actuator unit 21 overlap each other with respect to a widthwise direction of the passage unit 4, i.e., a horizontal direction in FIG. 2.

Figure 3:
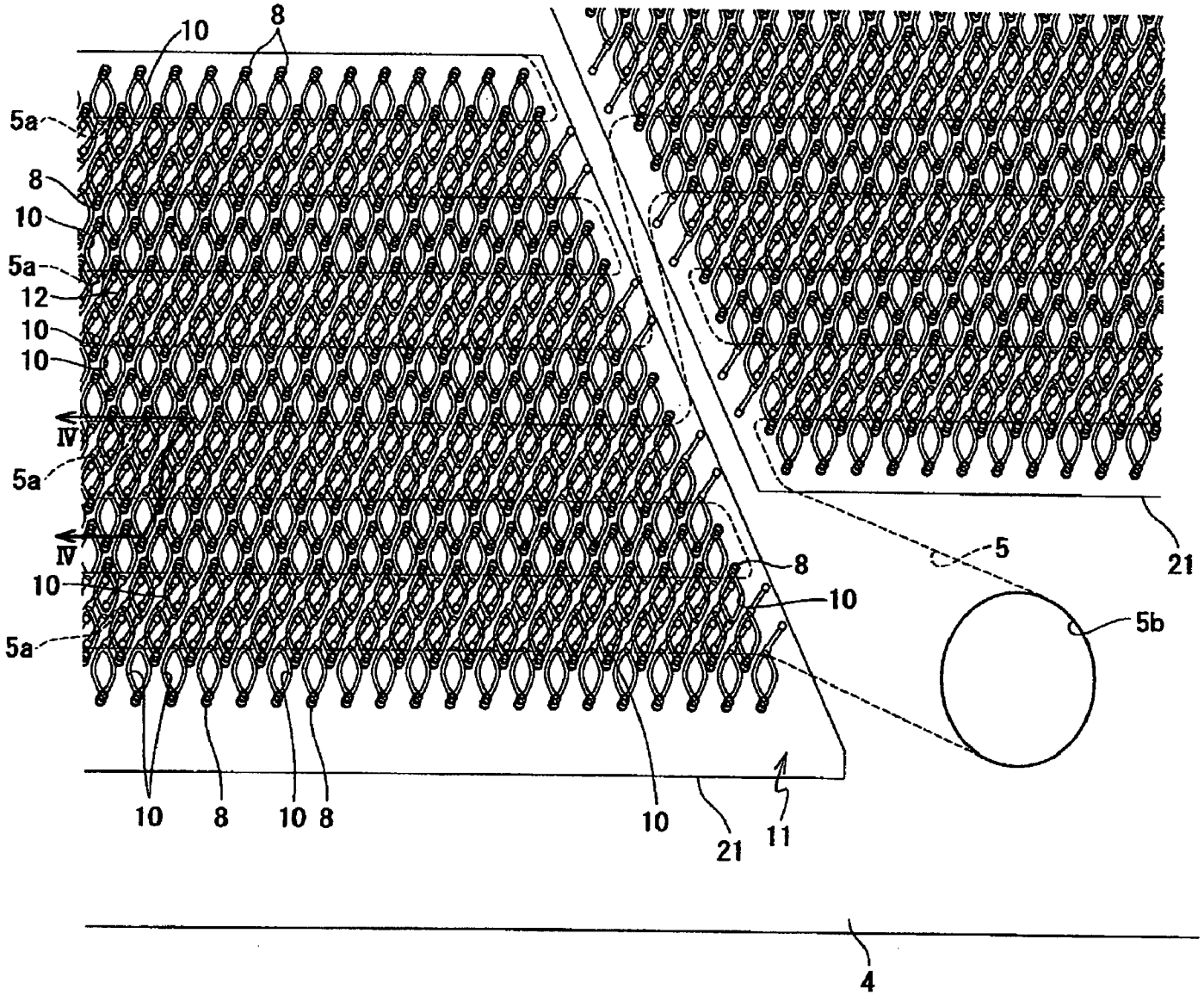
FIG. 3 is an enlarged view of a region shown in FIG. 2 enclosed with an alternate long and short dash line.

As shown in FIG. 3, the nozzles 8 and the pressure chambers 10 each having a rhombic shape in a plan view are arranged two-dimensionally and regularly, to be more specific, arranged in a matrix and zigzag pattern, in a region of the passage unit 4 where each actuator unit 21 is bonded. The nozzles 8 are arranged on an imaginary line along the extension direction of the passage unit 4 such that projective points of the respective nozzles 8 in a direction perpendicular to the imaginary line may appear at regular intervals of 600 dpi.

The sub manifold channel 5*a* branching from the manifold channel 5 extends along the extension direction of the passage unit 4 and across many pressure chambers 10. Four sub manifold channels 5*a* correspond to a single actuator unit 21. As shown in FIG. 2, openings 5*b* which communicate with the manifold channel 5 are formed in the upper face of the passage unit 4. Ink is supplied from an ink tank (not shown) through the openings 5*b* to the manifold channels 5.

The nozzles 8, the pressure chambers 10, the apertures 12, etc., which locate below the actuator unit 21, should be illustrated with broken lines, but in FIG. 3 they are illustrated with solid lines for the purpose of easy understanding of the figure.

Next, a construction of the passage unit 4 will be described in more detail with reference to FIG. 4.

The passage unit 4 has a layered structure of, from the top, a cavity plate 22, a base plate 23, an aperture plate 24, a supply plate 25, manifold channel plates 26, 27, 28, a cover plate 29, and a nozzle plate 30.

The cavity plate 22 is a metal plate in which formed are many rhombic holes serving as the pressure chambers 10. The base plate 23 is a metal plate in which formed are many communication holes each connecting each pressure chamber 10 to a corresponding aperture 12 and many communication holes each connecting each pressure chamber 10 to a corresponding nozzle 8. The aperture plate 24 is a metal plate in which formed are many holes serving as apertures 12 and many communication holes each connecting each pressure chamber 10 to a corresponding nozzle 8. The supply plate 25 is a metal plate in which formed are many communication holes each connecting each aperture 12 to a sub manifold channel 5*a* and many communication holes each connecting each pressure chamber 10 to a corresponding nozzle 8. The manifold channel plates 26, 27, 28 are metal plates in which formed are holes serving as the sub manifold channels 5*a* and many communication holes each connecting each pressure chamber 10 to a corresponding nozzle 8. The cover plate 29 is a metal plate in which formed are many communication holes each connecting each pressure chamber 10 to a corresponding nozzle 8. The nozzle plate 30 is a metal plate in which many nozzles 8 are formed. These nine metal plates are positioned to and layered on one another such that the individual ink passages 32 may be formed therein.

Next, a construction of the actuator unit 21 will be described with reference to FIGS. 5, 6, and 7.

Figure 5:
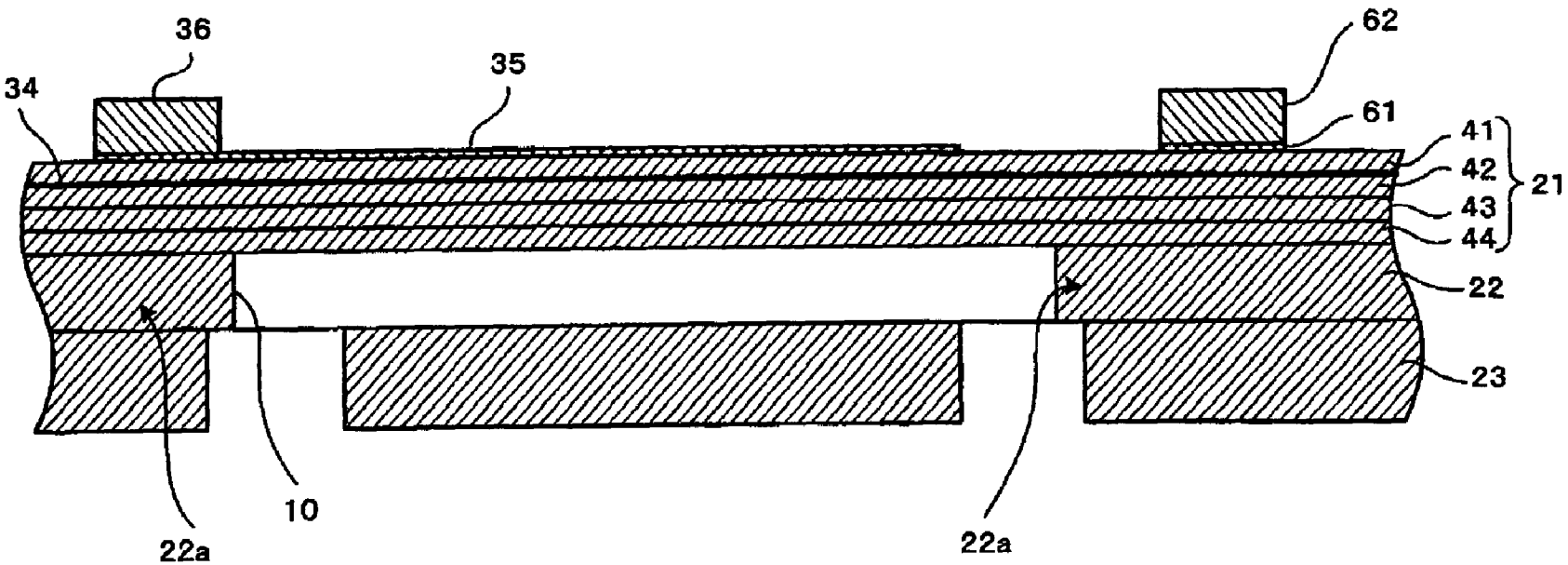
FIG. 5 is an enlarged view of a region shown in FIG. 4 enclosed with an alternate long and two short dashes line.

As shown in FIG. 5, the actuator unit 21 has four piezoelectric sheets 41, 42, 43, and 44 that are layered on one another. The piezoelectric sheets 41 to 44, each having a thickness of approximately 15 μm and a trapezoidal shape in a plan view, are made of a lead zirconate titanate (PZT)-base ceramic material having ferroelectricity.

Individual electrodes 35 corresponding to the respective pressure chambers 10 are formed on the uppermost piezoelectric sheet 41. A common electrode 34 of approximately 2 μm thickness are interposed between the uppermost piezoelectric sheet 41 and the piezoelectric sheet 42 disposed thereunder in such a manner that the common electrode 34 may be formed over an entire surface of the piezoelectric sheets. No electrode exists between the piezoelectric sheet 42 and the piezoelectric sheet 43 and between the piezoelectric sheet 43 and the piezoelectric sheet 44. The individual electrodes 35 and the common electrode 34 are made of, e.g., an Ag—Pd-base metallic material.

Figure 7:
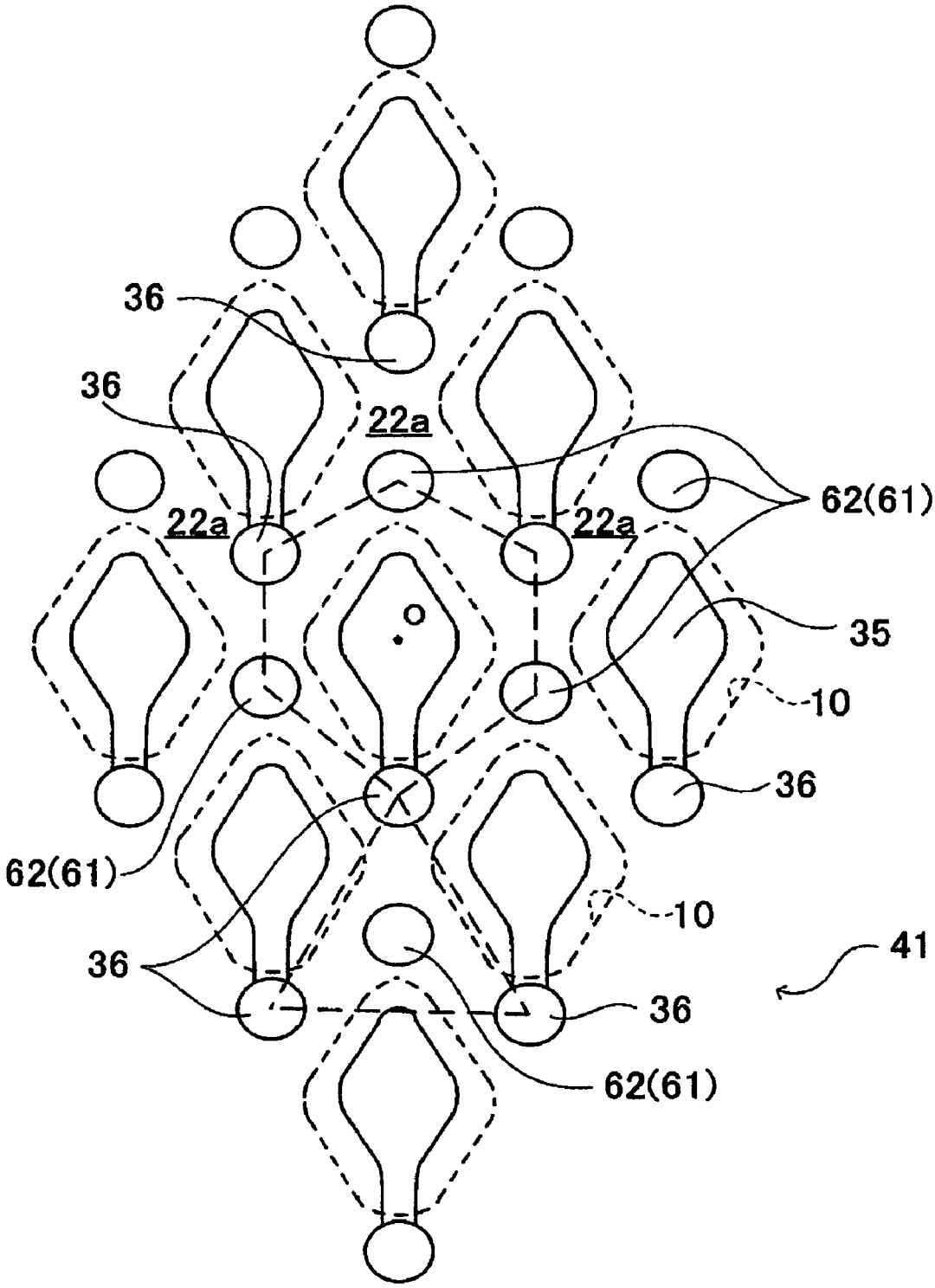
FIG. 7 is a local view of FIG. 6.

The individual electrode 35 has a thickness of approximately 1 μm, and as shown in FIG. 7 has a substantially rhombic planar shape which is almost similar to a planar shape of the pressure chamber 10 (see FIG. 3). The most part of each of the individual electrodes 35, which respectively correspond to the pressure chambers 10, is located within a corresponding pressure chamber 10 in a plan view. Moreover, a center of the substantially rhombic portion of each individual electrode 35 coincides with a center of a corresponding pressure chamber 10.

As shown in FIGS. 5 and 7, one acute portion of the substantially rhombic individual electrode 35 is extended to a region of the passage unit 4 corresponding to a wall 22*a* which defines the pressure chamber 10, i.e., extended to a portion of the cavity plate 22 where no pressure chamber 10 is formed. A circular land 36 is provided at an end of this extended portion. The land 36 is made of, e.g., gold including glass frits and bonded onto a surface of the extended portion of the individual electrode 35, as shown in FIG. 5. The land 36 is electrically connected to the individual electrode 35.

A lamination of a lower spacer layer 61 and a middle spacer layer 62 as laminated with each other is provided symmetrically to the land 36 with respect to a center of the pressure chamber 10 in a plan view. This lamination is, similarly to the land 36, provided in a region on the uppermost piezoelectric sheet 41 corresponding to the wall 22*a*. In a plan view, each of the lower spacer layer 61 and the middle spacer layer 62 has the same shape as that of the land 36, that is, has a circular shape whose diameter is equal to that of the land 36. The lower spacer layer 61 has the same thickness as that of the individual electrode 35, and is made of the same conductive material as that of the individual electrode 35. However, the lower spacer layer 61 is a dummy electrode to which no drive signal is given. The middle spacer layer 62 provided on the lower spacer layer 61 has the same thickness as that of the land 36, and is made of the same conductive material as that of the land 36. However, the middle spacer layer 62 is a dummy land to which a drive signal is not transmitted. One individual electrode 35 is provided with one lamination of the lower spacer layer 61 and the middle spacer layer 62, as well as one land 36.

Figure 6:
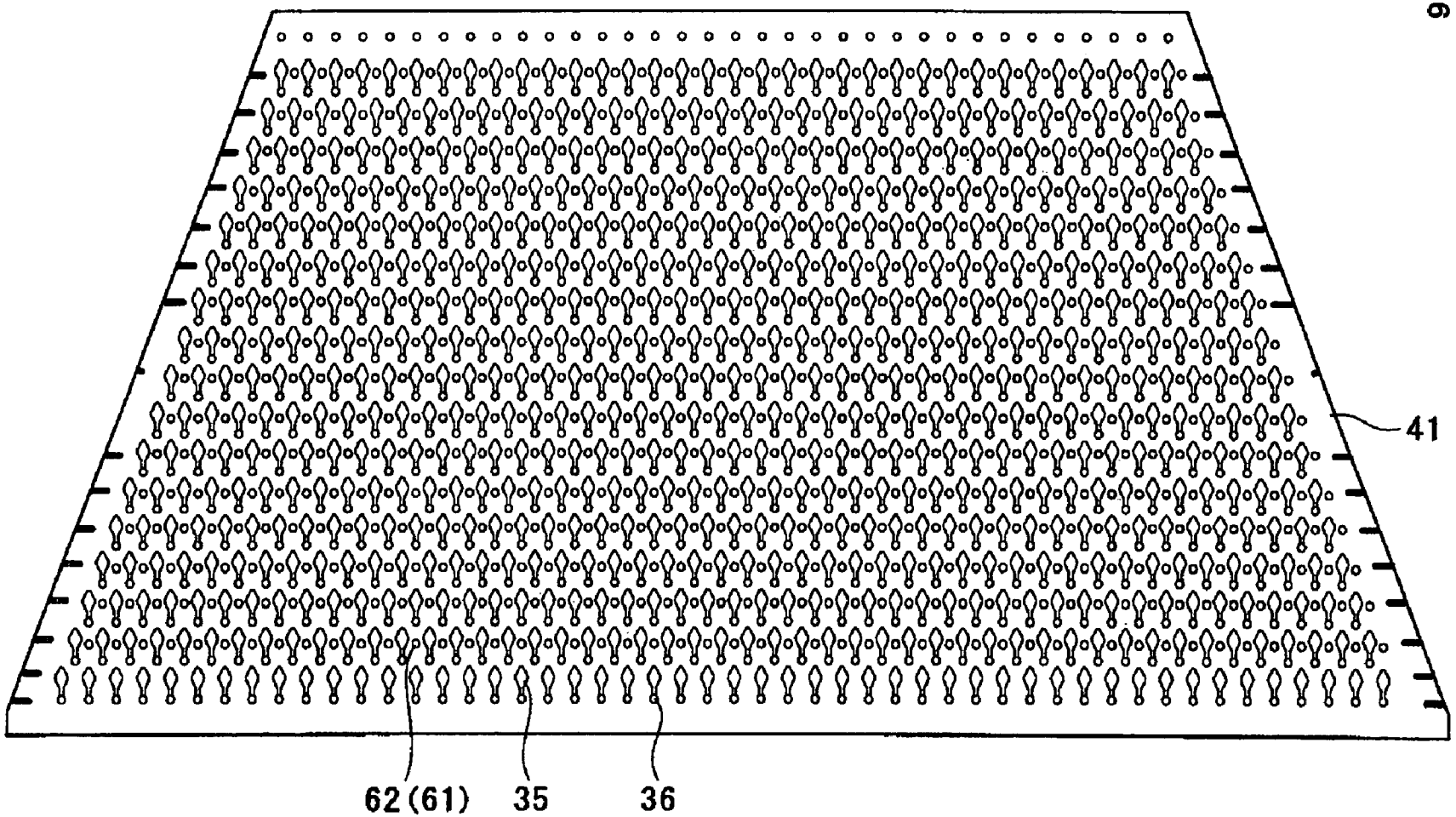
FIG. 6 is an enlarged plan view of an actuator unit illustrated in FIG. 2.

As shown in FIGS. 6 and 7, the individual electrodes 35 are arranged two-dimensionally and regularly, to be more specific, arranged in a matrix and zigzag pattern, over a substantially entire upper face of the piezoelectric sheet 41, which is the same manner as the pressure chambers 10 are arranged as shown in FIG. 3. On the piezoelectric sheet 41, moreover, the lands 36 and the laminations, each including the lower spacer layer 61 and the middle spacer layer 62, are arranged regularly with a uniform spatial density distribution.

Referring to a center part of FIG. 7, immediate neighboring three lands 36 and three laminations each including the lower spacer layer 61 and the middle spacer layer 62 are placed at vertexes of a regular hexagon in a plan view. To be more specific, a land 36 and a lamination both corresponding to an individual electrode 35 illustrated at the center of FIG. 7, two laminations respectively corresponding to two individual electrodes 35 illustrated on lower right and left of the aforesaid individual electrode 35, and two lands 36 respectively corresponding to two individual electrodes 35 illustrated on upper right and left of the aforesaid individual electrode 35 are placed at vertexes of a regular hexagon in a plan view.

Centers of three lands 36, which respectively correspond to three electrodes 35 including a center electrode 35 and two electrodes 35 disposed on lower right and left sides of the center electrode 35 in FIG. 7, form a regular triangle. In addition, a lamination of the lower spacer layer 61 and the middle spacer layer 62 is located at the centroid of this regular triangle. That is, each lamination is located within a region surrounded by three lands 36 that form a regular triangle.

The common electrode 34 is grounded and kept at the ground potential equally at every region corresponding to a pressure chamber 10 of the passage unit 4. On the other hand, the individual electrodes 35 corresponding to the respective pressure chambers 10 are electrically connected to a driver IC (not shown) of the controller 100 independently of one another such that a potential of one individual electrode 35 may be controlled independently of a potential of another one.

Next, driving of the actuator unit 21 will be described.

The actuator unit 21 is of the so-called unimorph type, and the uppermost piezoelectric sheet 41 is polarized in its thickness direction. The piezoelectric sheet 41 has many active portions sandwiched between the respective individual electrodes 35 and the common electrode 34, while the other piezoelectric sheets 42 to 44 have no active portion.

For example, while there is no ejection request, an individual electrode 35 is kept at a potential (hereinafter referred to as a "low potential") equal to the potential of the common electrode 34, and upon an ejection request the individual electrode 35 is set at a potential (hereinafter referred to as a "high potential") higher than that of the common electrode 34, so that ink is ejected a the nozzle 8. While the individual electrode 35 is having the low potential, the piezoelectric sheets 41 to 44 keep a flat shape. When an individual electrode 35 is set at the high potential so that an electric field occurs in the thickness direction of the piezoelectric sheet 41 which is the same as the polarization direction, an active portion of the piezoelectric sheet 41 corresponding to this individual electrode 35 contracts by a transversal piezoelectric effect in a direction along a plane of the sheet which is perpendicular to the thickness direction. At this time, the other piezoelectric sheets 42 to 44 are not influenced by the electric field and therefore do not contract by themselves. Accordingly, the uppermost piezoelectric sheet 41 and the other piezoelectric sheets 42 to 44 exhibit different strains along the plane of the sheet. As a result, the piezoelectric sheets 41 to 44 as a whole are deforming downward into a convex shape, i.e., present a unimorph deformation. Here, as shown in FIG. 5, the piezoelectric sheets 41 to 44 are fixed to an upper face of the cavity plate 22 in which the holes serving as the pressure chambers 10 are formed. Therefore, the piezoelectric sheets 41 to 44 deform into a convex shape toward the pressure chambers 10. This deformation causes the volume of the pressure chamber 10 to be reduced and pressure of ink contained in the pressure chamber 10 rises, consequently ejecting ink from the nozzle 8. Then, when the individual electrode 35 is set at the low potential, the piezoelectric sheets 41 to 44 is going to restore their original flat shape. At this time, pressure in the pressure chamber 10 changes so that ink flows from the sub manifold channel 5*a* into the pressure chamber 10.

In another possible driving mode, while there is no ejection request an individual electrode 35 is kept at the high potential, and upon an ejection request the individual electrode 35 is set at the low potential and then at the high potential again at a predetermined timing. While the individual electrode 35 is having the high potential, the piezoelectric sheets 41 to 44 take a convex shape toward the pressure chamber 10 as described above. When the individual electrode 35 is set at the low potential, the piezoelectric sheets 41 to 44 become flat so that the volume of the pressure chamber 10 increases as compared with at the high potential. At this time, the pressure chamber 10 incurs negative pressure therein, so that ink flows from the sub manifold channel 5*a* into the pressure chamber 10. Then, when the individual electrode 35 is set at the high potential again, the piezoelectric sheets 41 to 44 deform again into a convex shape toward the pressure chamber 10. This reduces the volume of the pressure chamber 10 and thus the pressure chamber 10 incurs positive pressure therein. Increased pressure is therefore given to ink contained in the pressure chamber 10, to eject ink from the nozzle 8.

Next, a bonding between the actuator unit 21 and the FPC 50 will be described with reference to FIG. 8.

The FPC 50 includes a base film 51 of approximately 25 μm thickness and a cover film 52 made of a photoresist of approximately 25 μm thickness. The cover film 52 covers substantially a whole of a lower face of the base film 51. Many wirings 53 of approximately 9 μm thickness are sandwiched between the base film 51 and the cover film 52. A through hole 52*a* having a diameter smaller than that of the land 36 is formed at a portion of the cover film 52 corresponding to each land 36.

Each of the base film 51 and the cover film 52 is an insulative sheet member. The base film 51 is made of a polyimide resin, and the cover film 52 is made of a photosensitive material. The employment of the photosensitive material allows many through holes 52*a* to be easily formed in the cover film 52.

The wirings 53 are made of copper and provided in one-to-one correspondence to the individual electrodes 35. Each wiring 53 has its one end extending to reach the through hole 52*a* and its other end connected to a driver IC (not shown) that is included in the controller 100. The wiring 53 expands along a plane of the cover film 52 so that it forms at its one end a contact 54 that corresponds to the land 36 and has substantially the same diameter as that of the land 36. A center of the contact 54 substantially coincides with a center of the through hole 52*a*. Seen from a bottom side of the cover film 52, a middle of the contact 54 is exposed out.

Each contact 54 and a corresponding land 36 are positioned such that they may coincide with each other in a plan view. A thermosetting conductive adhesive layer 37 is disposed on a surface of the land 36. The conductive adhesive layer 37 has a cylindrical shape with substantially the same diameter as that of the land 36 and a thickness of approximately 40 μm. An upper end of the conductive adhesive layer 37 has a protrusion 37*a*. The protrusion 37*a* fits into the through hole 52*a* of the cover film 52 and comes into contact with the middle of the contact 54, thereby electrically connecting each contact 54 with the individual electrode 35 via the conductive adhesive layer 37 and the land 36.

An upper spacer layer 63 made of a thermosetting conductive adhesive layer is disposed on a surface of the middle spacer layer 62. The upper spacer layer 63 has a shape similar to that of the conductive adhesive layer 37. That is, the upper spacer layer 63 has a circular shape in a plan view, substantially the same diameter as the diameter of the land 36, and a thickness of approximately 40 μm which is the same as the thickness of the conductive adhesive layer 37. The layered lower, middle, and upper spacer layers 61, 62, and 63, as a whole, constitute a spacer 65 which keeps a clearance between the actuator unit 21 and the FPC 50. No contact 54 is provided on the spacer 65. Thus, the spacer 65 is at the floating potential and is not electrically connected to the individual electrode 35 and the wiring 53 of the FPC.

The spacer 65 is positioned such that it may not coincide with the contact 54 in a plan view but may correspond to a recess 52*b* formed in the lower face of the cover film 52. An upper end of the upper spacer layer 63 has a protrusion 63*a*.

The protrusion 63*a* fits into the recess 52*b* of the cover film 52, so that the spacer 65 is firmly bonded to the cover film 52.

A height of the spacer 65 is equal to a distance between the actuator unit 21 and the FPC 50 in a region where the land 36 and the conductive adhesive layer 37 are disposed, that is, equal to a total thickness of the individual electrode 35, the land 36, and the conductive adhesive layer 37. The FPC 50 keeps its flatness without bending over the whole area of the actuator unit 21, and a distance between the actuator unit 21 and the FPC 50 is kept constant.

Here, a method for manufacturing the ink-jet head 2 will be described.

First, the passage unit 4 and the actuator unit 21 are prepared separately. The passage unit 4 is prepared by positioning the plates 22 to 30 and bonding them to one another with an adhesive. In order to prepare the actuator unit 21, four layered green sheets with the common electrode 34 sandwiched between the topmost green sheet and the next topmost green sheet are baked, and then the baked material is cut into a shape of the actuator unit 21. Then, conductive paste which will form the individual electrodes 35 and the lower spacer layers 61 is applied into a uniform thickness on the uppermost piezoelectric sheet 41. Further, conductive paste which will form the lands 36 and the middle spacer layers 62 is applied into a uniform thickness, and then a heat treatment is conducted. Each actuator unit 21 thus obtained is positioned and bonded to the upper face of the passage unit 4 with an adhesive.

Next is a process of bonding the FPC 50 to the actuator unit 21. The same amount of thermosetting conductive adhesive is applied to surfaces of the lands 36 and the middle spacer layers 62, so that the conductive adhesive layers 37 and the upper spacer layers 63 are formed. Thereafter, the FPC 50 is positioned to the actuator unit 21 such that, in a plan view, a center of each through hole 52*a* may coincide with a center of a corresponding conductive adhesive layer 37 and a center of a corresponding land 36. Then, a ceramic heater is put on the FPC 50, to press the FPC 50 onto the actuator unit 21 while heating the conductive adhesive layers 37 and the upper spacer layers 63 up to no less than a curing temperature. Since the conductive adhesive layers 37 and the upper spacer layers 63 are cured through this heat and pressure treatment, the FPC 50 is firmly bonded to the actuator unit 21 and in addition the contacts 54 of the FPC 50 and the individual electrodes 35 of the actuator unit 21 are electrically connected via the conductive adhesive layers 37 and the lands 36.

In the ink-jet head 2 of this embodiment, as described above, deformation of the FPC 50 toward the actuator unit 21 due to, for example, heat treatment for bonding the FPC 50 to the actuator unit 21 or warpage of the FPC 50 over time after the bonding process can be suppressed because the spacers 65 disposed between the actuator unit 21 and the FPC 50 support the FPC 50. Therefore, the FPC 50 hardly comes into contact with a region of the actuator unit 21 corresponding to a pressure chamber 10, thus preventing hindrance of deformation of the actuator unit 21 which may be caused by the FPC 50 coming into contact with the actuator unit 21.

Figure 8:
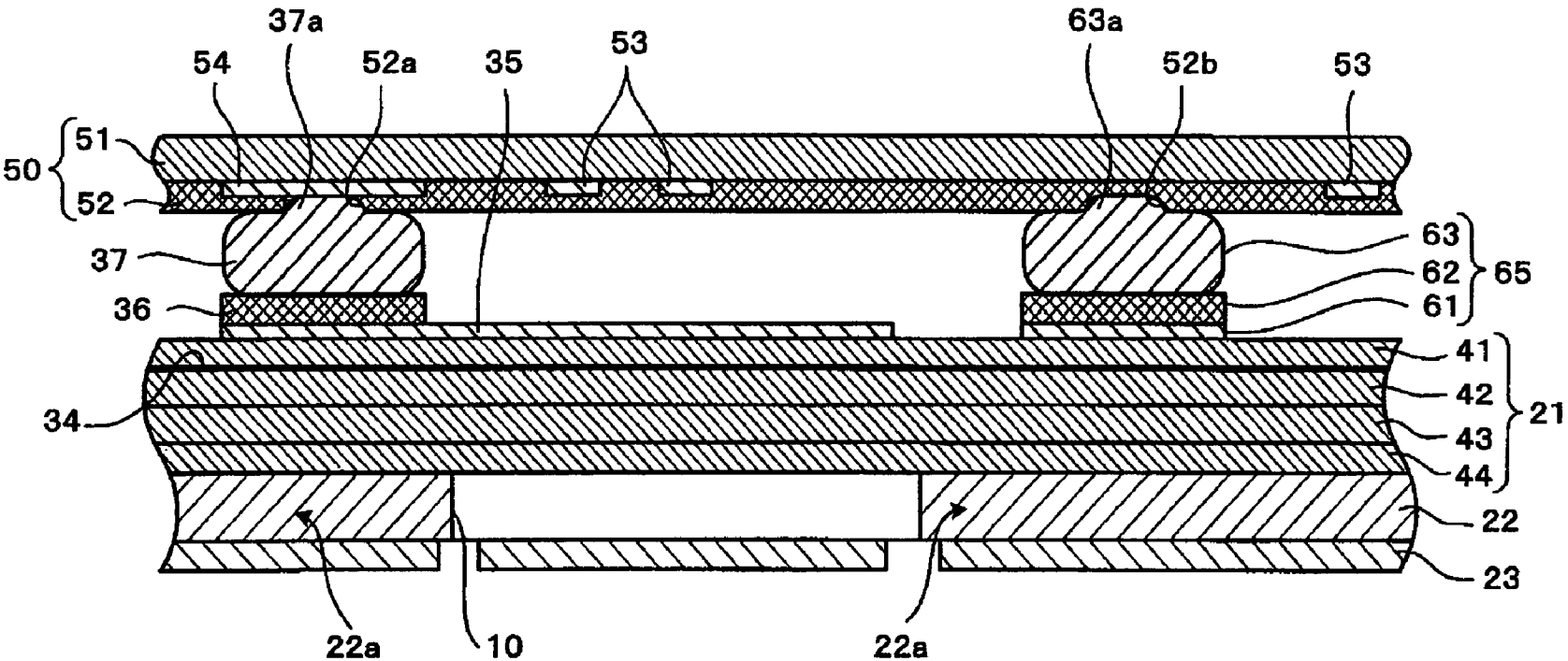
FIG. 8 is a sectional view showing a bonding between an actuator unit and an FPC.

As shown in FIG. 8, one conductive adhesive layer 37 and one spacer 65 correspond to each individual electrode 35. This can enhance preventing the FPC 50 from coming into contact with a region of the actuator unit 21 corresponding to a pressure chamber 10.

In addition, this embodiment presents the following features, thus further enhancing preventing the FPC 50 from coming into contact with a region of the actuator unit 21 corresponding to a pressure chamber 10. As shown in FIGS. 6 and 7, the spacers 65 are regularly arranged. Note that in FIGS. 6 and 7 the spacer 65 is shown at the position of the lower and middle spacer layers 61 and 62, and the conductive adhesive layer 37 is shown at the position of the land 36. As shown in FIG. 7, a land 36 and a lamination of the lower spacer layer 61 and the middle spacer layer 62 are positioned symmetrically with respect to a center of one of the pressure chambers 10 that corresponds to their corresponding individual electrode 35 in a plan view. Referring to the center part of FIG. 7, three lands 36 and three laminations each including the lower spacer layer 61 and the middle spacer layer 62 are arranged symmetrically with respect to a center of the pressure chamber 10 and placed at vertexes of a regular hexagon. Referring to the lower part of FIG. 7, three lands 36 which respectively correspond to three immediate neighboring individual electrodes 35 are placed at vertexes of a regular triangle, and a lamination of the lower spacer layer 61 and the middle spacer layer 62 is located at a centroid of this regular triangle. Referring to FIGS. 3 and 6, moreover, both the pressure chambers 10 and the individual electrodes 35 are arranged in a matrix and zigzag pattern in a direction parallel to a plane of the piezoelectric sheet 41.

As shown in FIG. 8, the spacer 65 has height equal to a distance between the actuator unit 21 and the FPC 50 in a region where the conductive adhesive layer 37 is disposed. In this case, the spacer 65 and the conductive adhesive layer 37 reliably supports the FPC 50. Therefore, in bonding the FPC 50 to the actuator unit 21, bonding pressure can be increased while restraining the FPC 50 from coming into contact with a region of the actuator unit 21 corresponding to a pressure chamber 10. Since the increased bonding pressure can thus be applied, the FPC 50 and the actuator unit 21 are firmly bonded to each other. This can suppress occurrence of open failure which may be caused by warpage of the FPC 50, etc.

In this embodiment, the spacer 65 is bonded to both the actuator unit 21 and the FPC 50. Thus, in comparison with the otherwise case, the number of points at which the FPC 50 and actuator unit 21 are bonded is increased, to be more specific, doubled, so that the FPC and the actuator unit can be bonded with increased strength. This can enhance the suppression of occurrence of open failure which may otherwise be caused by warpage of the FPC 50, etc. Since the FPC and the actuator unit can be bonded with increased strength, handling ability of the head 2 having the FPC 50 bonded thereto is improved.

Both of the conductive adhesive layer 37 and the spacer 65, which are positioned symmetrically with respect to the center of the substantially rhombic portion of the individual electrode 35 located within the pressure chamber 10 in a plan view, are bonded to the FPC 50. This can reduce direction dependency of stress on the active portion of the piezoelectric sheet 41 given from its surroundings during an ink ejection. Thereby, the nozzle 8 can be restrained from showing irregular ink ejection characteristics.

The conductive adhesive layers 37 and the spacers 65 are disposed at positions on the passage unit 4 corresponding to the walls 22*a* which define the pressure chambers 10, and therefore they hardly hinder deformation of the actuator unit 21. With this configuration, moreover, pressure applied on the actuator unit 21 for bonding the FPC 50 to the actuator unit 21 is transmitted to the walls 22*a*. If the pressure is applied to portions of the actuator unit 21 corresponding not to the walls 22*a* but to the pressure chambers 10, the portions of the actuator unit 21 corresponding to the pressure chambers 10 may be damaged because the pressure chambers 10 are cavities. However, such damage can be avoided in this embodiment.

Since the individual electrodes 35 are formed on a surface of the actuator unit 21 facing the FPC 50, electrical connection between the individual electrodes 35 and the wirings 53 can be made relatively easily without providing through holes or the like in the actuator unit 21. Further, since the individual electrodes 35 are formed only on the surface of the actuator unit 21, the uppermost piezoelectric sheet 41 alone of the actuator unit 21 includes the active portions. As a consequence, efficiency of the unimorph deformation of the actuator unit 21 becomes excellent.

As shown in FIG. 8, a construction of the spacer 65 is the same as a construction formed between the actuator unit 21 and the FPC 50 in a region where the conductive adhesive layer 37 is disposed. Accordingly, the spacer 65 can be manufactured through a simplified process. More specifically, the spacer 65 includes the lower spacer layer 61 having the same thickness and made of the same conductive material as those of the individual electrode 35, the middle spacer layer 62 having the same thickness and made of the same conductive material as those of the land 36, and the upper spacer layer 63 having the same thickness and made of the same conductive material as those of the conductive adhesive layer 37. Thus, the individual electrode 35 and the lower spacer layer 61 can be formed in the same process, the land 36 and the middle spacer layer 62 can be formed in the same process, and the conductive adhesive layer 37 and the upper spacer layer 63 can be formed in the same process. The manufacturing process can thereby be simplified.

The conductive adhesive layer 37 and the upper spacer layer 63 are made of the conductive adhesive. This can simplify the manufacturing process, as compared with solder, etc., being employed for bonding the FPC 50 and the actuator unit 21.

The land 36 is bonded to the individual electrode 35, and the conductive adhesive layer 37 is bonded to this land 36. With this configuration, even if large pressure is applied in order to bond the FPC 50 to the actuator unit 21 to thereby cause the conductive adhesive layer 37 to deform in a lateral direction, the presence of the land 36 serves to keep a proper clearance between the FPC 50 and the actuator unit 21. Therefore, even under large pressure in the bonding process, it is hard for the FPC 50 to come into contact with a region of the actuator unit 21 corresponding to a pressure chamber 10. Alternatively, even if the FPC 50 deforms under the heat treatment or deforms over time, the FPC 50 hardly comes into contact with a region of the actuator unit 21 corresponding to a pressure chamber 10 because there is a relatively large clearance between the FPC 50 and the actuator unit 21.

Figure 9:
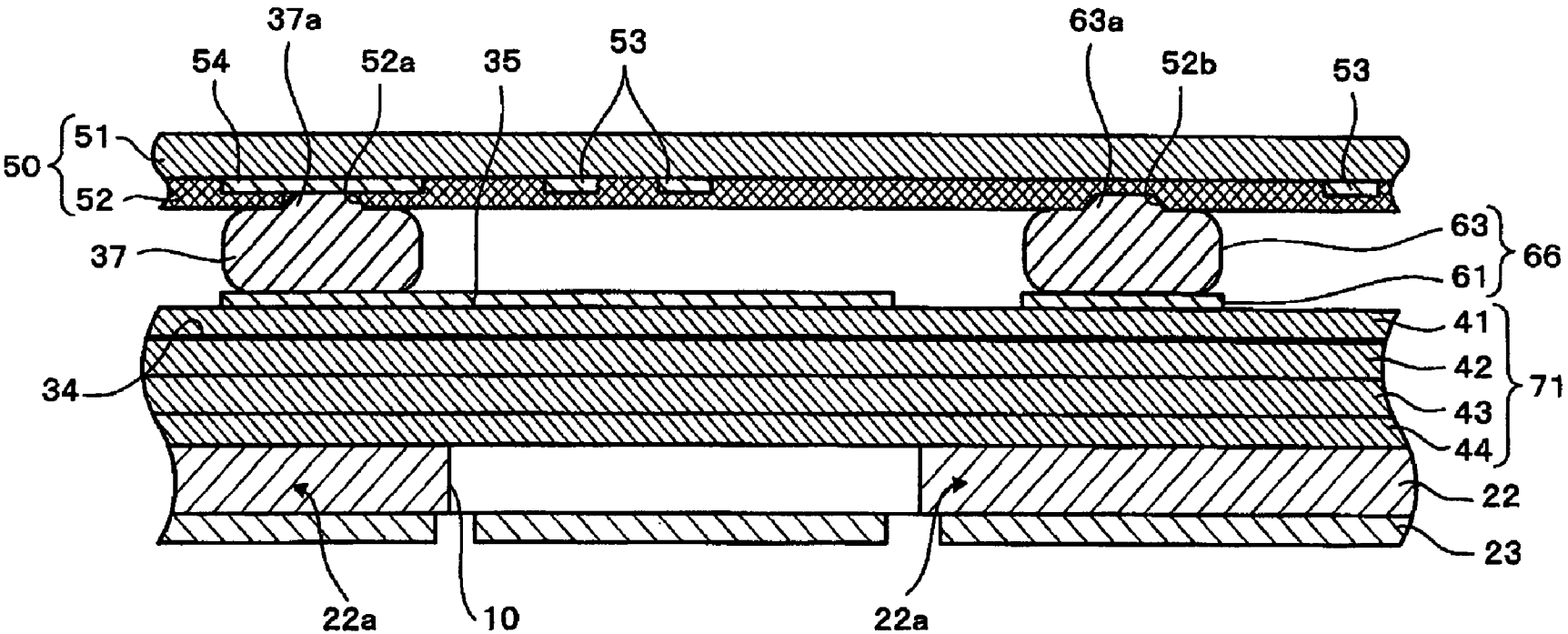
FIG. 9 is a sectional view showing a bonding between an actuator unit and an FPC according to a second embodiment of the present invention.

Next, an ink-jet head according to a second embodiment of the present invention will be described with reference to FIG. 9. This embodiment differs from the first embodiment only in that the land 36 and the middle spacer layer 62 are not provided. In the following, the same members as those of the above-described embodiment are denoted by common reference numerals without a specific description thereof.

In this embodiment, a conductive adhesive layer 37 is provided on an extended portion of an individual electrode 35 without a land 36 (see FIG. 8) being interposed, and the conductive adhesive layer 37 and the individual electrode 35 are electrically connected. Without a middle spacer layer 62 being interposed, an upper spacer layer 63 is provided on a lower spacer layer 61, and they are electrically connected. The lower spacer layer 61 and the upper spacer layer 63 form a spacer 66. A height of the spacer 66 is equal to a distance between an actuator unit 71 and a FPC 50 in a region where the conductive adhesive layer 37 is disposed, that is, equal to a total thickness of the individual electrode 35 and the conductive adhesive layer 37.

In this embodiment, the land 36 and the middle spacer layer 62 are not provided, and therefore the distance between the actuator unit 71 and the FPC 50 is shorter than that of the first embodiment. Accordingly, when too large pressure is applied in order to bond the FPC 50 to the actuator unit 71, the FPC 50 may come into contact with a region of the actuator unit 71 corresponding to a pressure chamber 10. However, this embodiment as well provides the spacer 66 which supports the FPC 50, so that even if the FPC 50 is going to deform under a heat treatment or going to deform over time, such a deformation can be suppressed. Thus, the FPC 50 hardly comes into contact with a region of the actuator unit 71 corresponding to a pressure chamber 10, and the same effect as in the first embodiment can be obtained.

The spacer 66 includes the lower spacer layer 61 having the same thickness and made of the same conductive material as those of the individual electrode 35, and the upper spacer layer 63 having the same thickness and made of the same conductive material as those of the conductive adhesive layer 37. Thus, the individual electrode 35 and the lower spacer layer 61 can be formed in the same process, and the conductive adhesive layer 37 and the upper spacer layer 63 can be formed in the same process. The manufacturing process can thereby be simplified.

Further, the conductive adhesive layer 37 and the upper spacer layer 63 are made of the conductive adhesive. This can simplify the manufacturing process, as compared with solder, etc., being employed for bonding the FPC 50 and the actuator unit 21.

Figure 10:
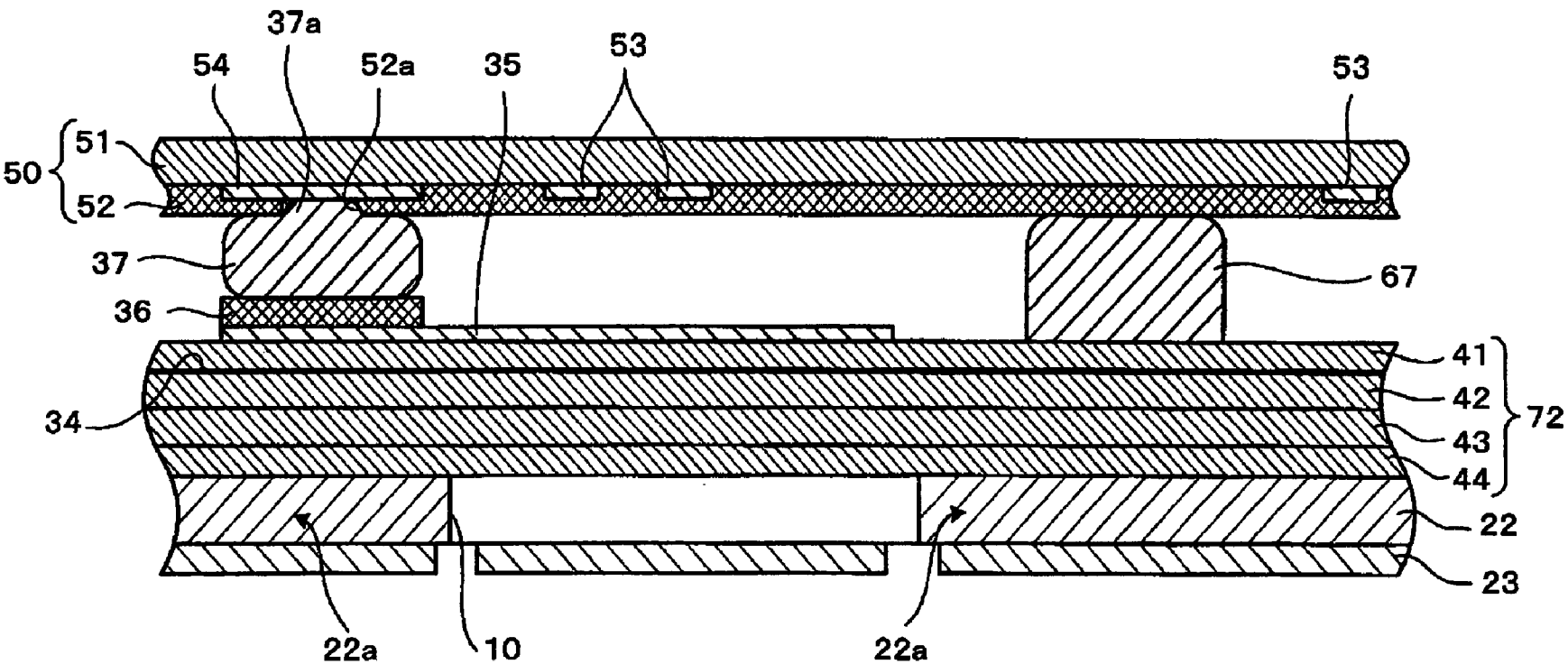
FIG. 10 is a sectional view showing a bonding between an actuator unit and an FPC according to a third embodiment of the present invention.

Next, an ink-jet head according to a third embodiment of the present invention will be described with reference to FIG. 10. This embodiment differs from the first embodiment only in a spacer construction. In the following, the same members as those of the above-described embodiments are denoted by common reference numerals without a specific description thereof.

A spacer 67 of this embodiment is not a lamination of spacer layers 61 to 63 but a single member. The spacer 67 is bonded on a surface of an actuator unit 72 facing a FPC 50 and protrudes upward therefrom. An upper end of the spacer 67 is bonded to a lower face of the FPC 50. A height of the spacer 67 is, similarly in the first embodiment, equal to a distance between the actuator unit 72 and the FPC 50 in a region where a conductive adhesive layer 37 is disposed, that is, equal to a total thickness of an individual electrode 35, a land 36, and a conductive adhesive layer 37.

Here will be described a method for manufacturing the ink-jet head of this embodiment, particularly a procedure for preparing the actuator unit 72 and a procedure for bonding the FPC 50 to the actuator unit 72.

In order to prepare the actuator unit 72, each of four green sheets are baked and cut into a shape of the actuator unit 72. Then, conductive paste which will form individual electrodes 35 and conductive paste which will form lands 36 are applied one over the other at the same positions on the uppermost piezoelectric sheet 41. Through a subsequent heat treatment, the actuator unit 72 is obtained.

In order to bond the FPC 50 to the actuator unit 72, first, a thermosetting conductive adhesive is applied to surfaces of the lands 36, thereby forming the conductive adhesive layers 37. In addition, a photoresist having the same thickness as that of the spacer 67 is applied onto the piezoelectric sheet 41, and openings are formed in portions of the photoresist where the spacers 67 will be provided. Then, these openings are filled with a conductive adhesive, and the photoresist is lifted off so that the spacers 67 appear. Thereafter, the actuator unit 72 and the FPC 50 are positioned and bonded to each other under heat and pressure. Thereby, a structure as shown in FIG. 10 is obtained.

As described above, this embodiment is different from the first embodiment because forming the spacers 67 cannot concurrent with forming the individual electrodes 35, the lands 36, and the conductive adhesive layers 37. Accordingly, the number of processes is more than that in the first embodiment. This embodiment is nevertheless advantageous because the spacer 67 is formed of a single member and therefore has a simple and strong construction. Except the spacer 67 is formed of a single member, this embodiment is identical to the first embodiment, with the same effect as of the first embodiment.

Figure 11:
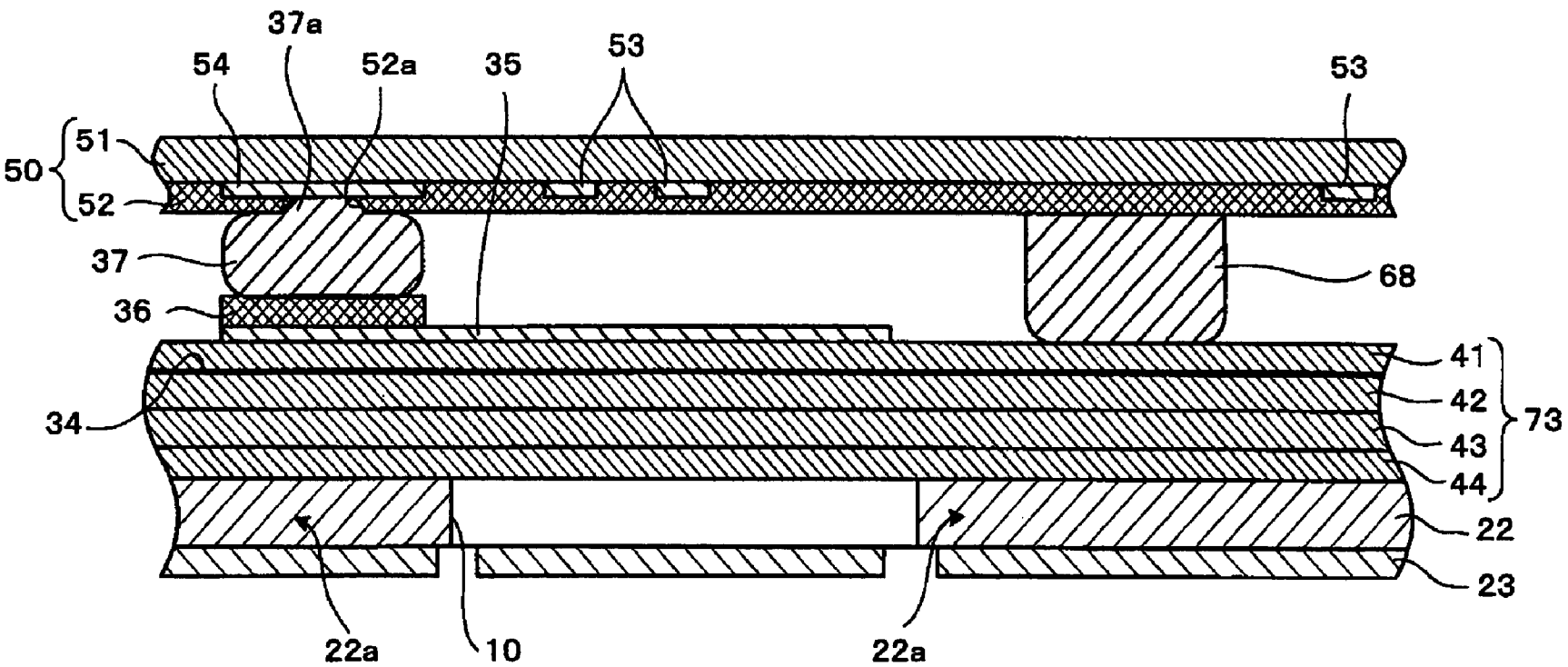
FIG. 11 is a sectional view showing a bonding between an actuator unit and an FPC according to a fourth embodiment of the present invention.

Next, an ink-jet head according to a fourth embodiment of the present invention will be described with reference to FIG. 11. In the following, the same members as those of the above-described embodiments are denoted by common reference numerals without a specific description thereof.

A spacer 68 of this embodiment is, similarly to in the third embodiment, is not a lamination of spacer layers 61 to 63 but a single member. The spacer 68 of this embodiment is bonded on a surface of a FPC 50 facing an actuator unit 73 and protrudes downward therefrom, while the spacer 67 of the third embodiment is bonded on the actuator unit 72. A lower end of the spacer 68 is bonded to an upper face of the actuator unit 73. A height of the spacer 68 is, similarly to in the first embodiment, equal to a distance between the actuator unit 73 and the FPC 50 in a region where a conductive adhesive layer 37 is disposed, that is, equal to a total thickness of an individual electrode 35, a land 36, and a conductive adhesive layer 37.

Here will be described a method for manufacturing the ink-jet head of this embodiment, particularly a procedure for bonding the FPC 50 to the actuator unit 73. A procedure for preparing the actuator unit 73 is the same as that of the third embodiment, and therefore its description will be omitted here.

In order to bond the FPC 50 to the actuator unit 73, first, a thermosetting conductive adhesive is applied to surfaces of the lands 36, thereby forming the conductive adhesive layers 37. In addition, a photoresist having the same thickness as that of the spacer 68 is applied onto a cover film 52, and openings are formed in portions of the photoresist where the spacers 68 will be provided. Then, these openings are filled with a conductive adhesive, and the photoresist is lifted off so that the spacers 68 appear. Thereafter, the actuator unit 73 and the FPC 50 are positioned and bonded to each other under heat and pressure. Thereby, a structure as shown in FIG. 11 is obtained.

As described above, this embodiment as well as the third embodiment is different from the first embodiment because forming the spacers 68 cannot concurrent with forming the individual electrodes 35, the lands 36, and the conductive adhesive layers 37. Accordingly, the number of processes is more than that in the first embodiment. This embodiment is nevertheless advantageous because the spacer 68 is formed of a single member and therefore has a simple and strong construction. Except the spacer 68 is formed of a single member, this embodiment is identical to the first embodiment, with the same effect as of the first embodiment.

An arrangement of the pressure chambers 10, the individual electrodes 35, the lands 36 and/or the conductive adhesive layers 37, and the spacers 65 is not limited to the one shown in FIG. 7. For example, the pressure chambers 10 and the individual electrodes 35 may not necessarily be arranged in a matrix or in a zigzag pattern. In addition, each individual electrode 35 may be provided with two or more spacers, and moreover the spacer may not necessarily locate symmetrically to the land 36 or to the conductive adhesive layer 37 with respect to the center of the pressure chamber 10. The spacer may be arranged not regularly but irregularly, as long as each spacer is disposed within a region surrounded by a plurality of conductive adhesive layers 37.

It is not always necessary that the height of the spacer is equal to the distance between the actuator unit 21 and the FPC 50 in the region where the conductive adhesive layer 37 is disposed. The height of the spacer may be larger or smaller than this distance.

The spacer need not be bonded to both the actuator unit 21 and the FPC 50. For example, the spacer may be bonded to only one of the actuator unit 21 and the FPC 50, or alternatively may be merely disposed without being bonded to them.

The land 36 and/or the conductive adhesive layer 37 and the spacer may not be disposed at positions on the passage unit 4 corresponding to the walls 22*a* which define the pressure chambers 10, but may be disposed at positions corresponding to the pressure chambers 10.

The construction of the spacer may be different from the construction formed between the actuator unit 21 and the FPC 50 in the region where the conductive adhesive layer 37 is disposed.

The material of the spacer may not always be the same as the material of the individual electrode 35 and the land 36. The spacer may include a insulating material, for example.

The spacer may have four or more layers.

The individual electrodes 35 are formed on the surface of the actuator unit 21 facing the FPC 50, but this is not limitative. For example, they can be formed between the piezoelectric sheet 42 and the piezoelectric sheet 43.

It is not always required that the land 36 is provided on the individual electrode 35 (see FIG. 5). The land 36 may alternatively be provided on the piezoelectric sheet 41 as long as electrical connection with the individual electrode 35 can be kept. In this case, the thickness of the land, i.e., the distance from the surface of the actuator unit 21 to the top of the land must be more than the thickness of the individual electrode 35, i.e., the distance therefrom to the top of the individual electrode 35. Further, the land must be bonded to the conductive adhesive layer 37 at its top.

In the above-described embodiments, the actuator units 21, 71, 72, and 73 are bonded to the FPC 50 with the conductive adhesive. However, other binders such as solder may be used instead.

The ink-jet head of the above-described embodiments is of a line-type, but the present invention is applicable to a serial-type ink-jet head.

The present invention is applicable not only to a line-type ink-jet head as in the above-described embodiments but also to a serial-type ink-jet head. An application of the head according to the present invention is not limited to printers, but may be facsimile or copying machines.

While this invention has been described in conjuction with the specific embodiments outlines above, it is evident that many alternatives, modifications and variations will be apparent to those skilled in the art. Accordingly, the prefered embodiments of the invention as set forth above are intended to be illustrative, not limiting. Various changes may be made without departing from the spirit and scope of the invention as defined in the following claims.

What is claimed is:

1. An ink-jet head comprising:

a passage unit having a plurality of nozzles and a plurality of pressure chambers that communicate with the respective nozzles and are arranged in a two-dimensional manner;

an actuator unit that is attached to the passage unit so as to cover two or more of the pressure chambers and has a plurality of individual electrodes corresponding to the respective pressure chambers, a common electrode formed to correspond to the individual electrodes, and a piezoelectric sheet sandwiched between the individual electrodes and the common electrode;

a flexible cable that has a plurality of wirings corresponding to the respective individual electrodes and is spaced apart from the actuator unit in a direction perpendicular to a plane of the piezoelectric sheet;

a plurality of conductors that are disposed between the actuator unit and the flexible cable so as to electrically connect the individual electrodes to the wirings, respectively; and a plurality of spacers that are disposed between the actuator unit and the flexible cable so that each of the spacers is positioned in a region surrounded by three or more of the conductors, the spacers not electrically connected to the individual electrodes and the wirings.

2. The ink-jet head according to claim 1, wherein one of the conductors and one or more of the spacers correspond to each one of the individual electrodes.

3. The ink-jet head according to claim 1, wherein the plurality of spacers are regularly arranged.

4. The ink-jet head according to claim 3, wherein one of the conductors and one of the spacers correspond to each one of the individual electrodes, and the conductor and the spacer are disposed symmetrically with respect to a center of one of the pressure chambers that corresponds to their corresponding individual electrode in a plan view.

5. The ink-jet head according to claim 3, wherein two or more of the conductors and two or more of the spacers are disposed symmetrically with respect to a center of the one of the pressure chambers in a plan view.

6. The ink-jet head according to claim 5, wherein three or more of the conductors and three or more of the spacers are disposed symmetrically with respect to a center of the one of the pressure chambers in a plan view.

7. The ink-jet head according to claim 6, wherein the three conductors and the three spacers are placed at vertexes of a regular hexagon.

8. The ink-jet head according to claim 3, wherein:

three conductors respectively corresponding to three immediate neighboring individual electrodes are placed at vertexes of a regular triangle; and the spacer is located at a centroid of the regular triangle.

9. The ink-jet head according to claim 3, wherein both of the pressure chambers and the individual electrodes are arranged in a matrix and zigzag pattern in a direction parallel to the plane of the piezoelectric sheet.

10. The ink-jet head according to claim 1, wherein each of the spacers has height substantially equal to a distance between the actuator unit and the flexible cable in a region where the conductors are disposed.

11. The ink-jet head according to claim 1, wherein the spacers are bonded to the flexible cable.

12. The ink-jet head according to claim 1, wherein the spacers are bonded to the actuator unit.

13. The ink-jet head according to claim 12, wherein the spacers are also bonded to the actuator unit.

14. The ink-jet head according to claim 1, wherein the conductors and the spacers are disposed in regions corresponding to walls that define the pressure chambers of the passage unit.

15. The ink-jet head according to claim 1, wherein a construction of the spacer is the same as a construction formed between the actuator unit and the flexible cable in a region where the conductor is disposed.

16. The ink-jet head according to claim 1, wherein the individual electrodes are formed on a surface of the actuator unit facing the flexible cable.

17. The ink-jet head according to claim 16, wherein the spacer includes a first spacer layer having substantially the same thickness and made of the same conductive material as those of the individual electrode, and a second spacer layer having substantially the same thickness and made of the same conductive material as those of the conductor.

18. The ink-jet head according to claim 17, wherein the conductor and the second spacer layer are made of a conductive adhesive.

19. The ink-jet head according to claim 16, wherein:

a conductive land, whose top is positioned at a distance more than that of the individual electrode from the surface of the actuator unit, is bonded to each of the individual electrodes; and the land is bonded to the conductor at its top.

20. The ink-jet head according to claim 19, wherein:

the land is disposed on the individual electrode; and the spacer includes a first spacer layer having substantially the same thickness and made of the same conductive material as those of the individual electrode, a second spacer layer having substantially the same thickness and made of the same conductive material as those of the land, and a third spacer layer having substantially the same thickness and made of the same conductive material as those of the conductor.

21. The ink-jet head according to claim 20, wherein the conductor and the third spacer layer are made of a conductive adhesive.

22. The ink-jet head according to claim 1, wherein the spacer is a single member that protrudes from a surface of the actuator unit toward the flexible cable.

23. The ink-jet head according to claim 1, wherein the spacer is a single member that protrudes from a surface of the flexible cable toward the actuator unit.

* * * * *